US010583476B2

(12) United States Patent
Beyersdorfer et al.

(10) Patent No.: US 10,583,476 B2
(45) Date of Patent: Mar. 10, 2020

(54) BENDING FORGE ROLLING

(71) Applicant: Hirschvogel Umformtechnik GmbH, Denklingen (DE)

(72) Inventors: Holger Beyersdorfer, OT Förtha (DE); Gerhard Linder, Fuchstal (DE)

(73) Assignee: Hirschvogel Umformtechnik GmbH, Denklingen (DE)

( * ) Notice: Subject to any disclaimer, the term of this patent is extended or adjusted under 35 U.S.C. 154(b) by 414 days.

(21) Appl. No.: 15/457,616

(22) Filed: Mar. 13, 2017

(65) Prior Publication Data

US 2018/0290200 A1 Oct. 11, 2018

(30) Foreign Application Priority Data

Mar. 15, 2016 (DE) ..... 10 2016 204 202

(51) Int. Cl.
*B21H 1/22* (2006.01)
*B21H 8/02* (2006.01)
(Continued)

(52) U.S. Cl.
CPC ..... *B21H 1/22* (2013.01); *B21B 27/02* (2013.01); *B21B 27/024* (2013.01); *B21H 8/02* (2013.01); *B21D 7/08* (2013.01)

(58) Field of Classification Search
CPC .... B21H 3/12; B21H 1/22; B21H 8/02; B21B 27/02; B21B 27/024; B21B 2267/18;
(Continued)

(56) References Cited

U.S. PATENT DOCUMENTS 105,668 A * 7/1870 Gilman ..... B21H 1/22 72/188
4,811,585 A 3/1989 Ryoichi et al.
5,632,174 A 5/1997 Hunter

FOREIGN PATENT DOCUMENTS

CN 101537449 A 9/2009
CN 101837412 A 9/2010
(Continued)

OTHER PUBLICATIONS

Machine translation of CN 101537449 to He et al.
(Continued)

*Primary Examiner* — Pradeep C Battula
(74) *Attorney, Agent, or Firm* — The H.T. Than Law Group

(57) ABSTRACT

The present invention relates to a forge rolling device (1) for the bending forge rolling of a component (2), in particular of a component blank, having a first forging roll (10) with a first axis of rotation (R), and a second forging roll with a second axis of rotation, wherein each of the forging rolls (10) has, on its surface (11), a forge rolling contour (12) that runs at least partially around its axis of rotation (R), said forge rolling contours (12) corresponding to one another, in order to form a component (2) passed between the forging rolls (10) in a passage direction (D). This forming can be bending with or without cross-sectional change. In this case, the forge rolling contours (12) are configured so as to bend the component (2), passed between the forging rolls (10), in at least one direction transversely to the passage direction (D) of the component (2), at least by means of one subregion (13) of the forge rolling contours (12). The present invention also relates to a method for the bending forge rolling of a component (2) and to a component (2) produced with the method according to the invention.

16 Claims, 6 Drawing Sheets

(51) Int. Cl.
*B21B 27/02* (2006.01)
*B21D 7/08* (2006.01)

(58) Field of Classification Search
CPC .... B21D 7/085; B21D 9/10; B29C 2043/461; B29C 2043/465; B29C 2043/466
See application file for complete search history.

(56) References Cited

FOREIGN PATENT DOCUMENTS

| | | | |
|---|---|---|---|
| CN | 203621369 | U | 6/2014 |
| CN | 205217909 | U | 5/2016 |
| DE | 10 2004 016 193 | A1 | 1/2008 |

OTHER PUBLICATIONS

Machine translation of CN 101837412 to Cao et al.
Machine translation of CN 203621369 to Shi et al.
Machine translation of CN 205217909 to Wang et al.
Search Report issued in connection with the corresponding Chinese patent application No. 201710311199.3 dated May 22, 2018.
Machine translation of DE 10 2004 016 193 to Muenster et al.
SMS Group: Reckwalzen Baureihen RW/ARWS. "Tradition Verpflichtet Zu Fortschritt". Ausg. May 2015, m Firmenshrift.
LASCO Unformtechnik GmbH: Vollautomatische Reckanlage, Ausg. May 2008, Firmenschrift.

* cited by examiner

BENDING FORGE ROLLING

FIELD OF THE INVENTION

The present invention relates to a forge rolling device for the bending forge rolling of a component, in particular of a component blank, and to a method for the bending forge rolling of such a component, and to a component itself, produced by the aforementioned method.

BACKGROUND OF THE INVENTION

The procedure known as forge rolling is known from the prior art. In this longitudinal rolling method, the cross-sectional area of components is changed in that the latter are passed through two rolls (rotating in opposite directions). The rolls have in this case a circumferential forge rolling contour. In this case, the individual regions of this contour are designed such that the profile cross section of the blank changes in the circumferential direction. By means of forge rolling, blanks or preforms are generally produced with a favorable mass distribution for downstream processes—for example drop forging processes. The targeted mass distribution is advantageous in order both to reduce the material input and the process forces in downstream forming processes (for example drop forging) and to increase the surface quality of the components.

SUMMARY OF THE INVENTION

Forge rolling is generally used for symmetrical preforms and finished forms. The components produced by means of forge rolling are generally embodied in a straight manner and symmetrical about the central axes of the starting blank. In order to produce for example forged parts with a complex geometry, for example pivot bearings with a very bent neck or axle journals, the component preworked by means of forge rolling has to be accordingly bent in a further stage (bending stage, setting stage, transverse extrusion) before it is fed to the final forging process for finishing.

Therefore, it is an object of the present invention to provide a device and a method for the forge rolling of a component, by means of which device and method it is possible to implement even relatively complex geometries.

This object is achieved by the subject matter of the independent claims. The dependent claims develop the central concept of the invention in a particularly advantageous manner.

According to a first aspect, the invention relates to a forge rolling device for the bending forge rolling of a component. This component can be in particular a component blank for example for producing a preform by means of the bending forge rolling method. The forge rolling device (also known as a forging manipulator) has a first forging roll with a first axis of rotation and a second forging roll with a second axis of rotation. Each of the forging rolls has, on its surface, a forge rolling contour that runs at least partially around its axis of rotation, said forge rolling contours corresponding to one another. The forge rolling contours of the two forging rolls are consequently formed and prepared so as to correspond to one another. The forge rolling contours make it possible to form a component passed between the forging rolls in a passage direction. In this case, as described below, said forming can be a pure bending operation (i.e. bending) without cross-sectional change, or a bending operation (i.e. bending) with cross-sectional change. In particular, to this end, the forge rolling contours are configured so as to bend the component, passed between the forging rolls, in at least one direction transversely to the passage direction of the component, at least in one subregion of the forge rolling contours; in particular to bend it with regard to its original longitudinal extension. In addition, a cross-sectional change can take place. The combination of forge rolling and bending (as a pure bending operation or as a bending operation with cross-sectional change) is also referred to in the context of the invention as "bending forge rolling", since a forge rolling method is used according to the invention at least to bend a component.

Consequently, by means of the forge rolling device according to the invention, a device is prepared by means of which preforms for producing relatively complex geometries—for example for pivot bearings—can be produced by forge rolling. The simultaneous bending and preferably also forming by cross-sectional change of the component thus makes it possible to produce bent components in the already provided forge rolling process, without changing the cycle time of the forge rolling process. In this way, a highly productive forge rolling operation with additional shaping (bending) of the component can be provided, such that complex components can be produced in a particularly simple and resource-friendly manner. As a result of the bending stage being integrated into the forge rolling process, additional forming stages and thus also losses of cycle time can be avoided. As already mentioned, forming can also comprise (merely) a pure bending operation.

The first and the second forging roll, at least the forge rolling contours of the first and second forging rolls, are preferably formed mirror symmetrically to one another. Thus, a desired geometry of the component can be provided reliably in a simple manner, wherein the provision of the workpieces (forging rolls) is also simplified.

In a preferred configuration, at least some of the forge rolling contour, as seen around the circumference of the respective forging roll, can extend transversely to a plane which is perpendicular to the respective axis of rotation, in order to bend the component, passed between the forging rolls, in at least one direction transversely to the passage direction of the component. In other words, the forge rolling contour does not extend in a straight manner, as seen around the circumference, as is the case in previously conventional forge rolling processes. Rather, the forge rolling device itself has a suitable tool design in order to produce components or component blanks bent by a stable process. The tool geometries are in this case worked out and implemented preferably with intensive application of the material flow FEM (finite elements method). The forging roll forms produced are thus not formed symmetrically with respect to the central planes of the starting material, and so, on account of the asymmetrical formation, the component can be bent.

The respective forge rolling contour can have, at least in one subregion, a side face which faces in an axial direction and via which the component can be bent. In a particularly preferred embodiment, the respective forge rolling contour has, at least in the subregion in which it extends transversely to the plane which is perpendicular to the respective axis of rotation, the side face which faces in an axial direction and preferably toward the side of the transverse extent and via which the component can be bent. In this way, a lateral abutment is provided, via which the component can be supported in order to be bent. The lateral bending force is consequently received via the tool, or the forge rolling device, such that a bending contour can be provided easily in the forging rolls.

In particular, the forge rolling contour can be in the form of a defined groove and in particular of a profile groove in at least one of the forging rolls. The other forging roll then has either a comparable or identical forge rolling contour. It is also conceivable for the forge rolling contour to be provided by the surface of the forging roll itself. The side face of the subregion of the forge rolling contour is particularly preferably formed by a side face of the groove, via which the component can then be supported in order to be bent. The forge rolling contour can thus be provided easily and in a substantially known manner.

That subregion of the forge rolling contour that serves to bend the component can transition for example continuously or discontinuously into the adjoining regions of the forge rolling contour. In this case, the forge rolling contour can be formed overall—at least in the subregions that serve for bending—in a stepped, arcuate or undulating manner. Of course, other contour shapes, as seen around the circumference of the forging roll, are also conceivable, these serving to form the desired, complex component geometry or preform, for example by corresponding cross-sectional change.

At least some of the radially extending normals connecting the forge rolling contour and the axis of rotation preferably intersect the axis of rotation, as seen around the circumference of the forging roll, at different points. This applies at least in that subregion of the forge rolling contour that serves for bending the component. As a result of the correspondingly extending forge rolling contour, it is thus easy to integrate a defined bending stage into the forge rolling process.

In the region in which the forging rolls of the forge rolling device are located closest together, it is possible for the mutually opposite forge rolling contours of the two forging rolls to some extent to laterally surround a forming region—i.e. at least in a region which faces the axes of rotation—through which the components can be passed in the passage direction in order to be formed. This forming region is of course open at least in the passage direction. By way of the forming region, it is thus possible to provide a forming contour which surrounds the component at least partially—preferably entirely—and by means of which component working that is particularly precise and defined and also reproducible is allowed.

The forging rolls are preferably arranged so as to be driven in opposite directions to one another. In this way, the forge rolling device preferably serves at the same time to drive, or pass through, the component to be formed by means of the forging rolls.

According to a particularly preferred embodiment, the forge rolling device has several forming stages, wherein at least one of the forming stages, preferably at least the last of the forming stages, has the first and second forging rolls according to the invention for (additionally) bending the component. The other forming stages can in this case likewise correspond to the forming stage according to the invention. At least one of the upstream forming stages can be configured in a conventional manner, however, and thus serve purely for material distribution—in particular as seen in the longitudinal direction of the component—i.e. in particular for the cross-sectional change of the component.

According to a further aspect, the invention also relates to a method for the bending forge rolling of a component, in particular of a component blank. This method according to the invention has the following steps of:

(a) providing a bending forge rolling device, preferably a bending forge rolling device according to the invention, (b) providing a component, in particular an elongate component, and (c) passing the component (preferably in the direction of its original longitudinal extension) between two forging rolls of the bending forge rolling device in the region of opposite forge rolling contours of the forging rolls in order to form the component, wherein the component is bent in at least one direction transversely to the passage direction of the component, at least in one subregion of the forge rolling contour.

The bending angle which can be achieved by means of the forming step according to the invention can in this case be defined as desired and results in particular from the forge rolling contour. According to preferred embodiments, the bending angle can be for example at most 300, preferably at most 40°, particularly preferably at most 50°. However, other bending angles up to almost 90° are also conceivable.

The advantages of the bending forge rolling method result in the same way as already described above for the forge rolling device according to the invention, and so reference is made at this point to what was stated above. In particular, it is possible with the method according to the invention to implement a pure bending operation or a bending operation with cross-sectional change.

According to a preferred embodiment, in step (c), the component can be bent in at least one direction transversely to the passage direction of the component, at least in one subregion of the forge rolling contour, in which at least some of the latter, as seen around the circumference of the respective forging roll, extends transversely to a plane which is perpendicular to the respective axis of rotation. In particular, the component can be bent transversely to its original longitudinal extension. This transverse direction is directed for example parallel to at least one of the axes of rotation of the forging rolls. The forging rolls are preferably driven in opposite directions.

At least during step (c) of the method according to the invention, in a region in which the forging s rolls are located closest together, the opposite forge rolling contours can to some extent laterally surround a forming region through which the components are passed in order to be formed. Particularly preferably, the forging rolls, at least the forge rolling contours, are provided preferably mirror symmetrically to one another.

In a preferred embodiment, step (c) can be carried out multiple times, preferably with forging rolls with different forge rolling contours. In this way, a staged bending forge rolling process can be provided.

In particular, the method according to the invention can also comprise a step for the longitudinal forge rolling of the component without bending, wherein this step is preferably carried out between steps (b) and (c), in order to form the component in the direction of its original longitudinal extension, and particularly preferably to distribute the material in a defined manner along its original longitudinal extension; thus to create a cross-sectional change. In this way, the advantages of the conventional forge rolling methods can be combined advantageously with the bending forge rolling method according to the invention.

According to a third aspect, the invention also relates to a component produced by the method according to the invention. The component preferably has at least a bending angle of up to 30°, preferably up to 40°, particularly preferably up to 50°, or even more. The component is preferably produced from metal, for example steel or aluminum. In principle, however, any materials are conceivable which can be subjected to a (bending) forge rolling process and can preferably also be used in forging processes.

BRIEF DESCRIPTION OF THE DRAWINGS

Further configurations and advantages of the present invention are described in the following text by way of the figures of the accompanying drawings, in which.

DETAILED DESCRIPTION OF THE PREFERRED EMBODIMENTS

Figure 1B:
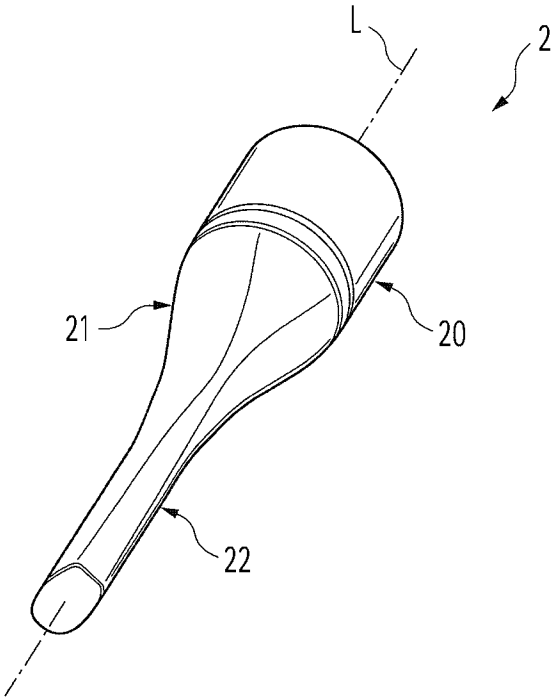
FIGS. 1*a* and 1*b* show two views of a component blank prior to forming by means of the bending forge rolling process according to the invention.

FIGS. 3 to 6 and their subparts show different exemplary embodiments of a forge rolling device 1 according to the invention for the bending forge rolling of a component 2, in particular of a component blank, in highly simplified illustrations. The forge rolling device 1 has a first forging roll 10 with a first axis of rotation R and a second forging roll with a second axis of rotation. For the sake of simplicity and for improved illustration of the forge rolling process, only one of the two forging rolls 10 is illustrated in the figures. The respectively other forging roll is preferably located above the drawing plane of the respective illustration, congruently with the first forging roll 10.

Each of the forging rolls 10 has on its surface 11 a forge rolling contour 12 that runs at least partially around its axis of rotation R. The forge rolling contours 12 of the two forging rolls 10 are in this case formed in a manner corresponding to one another. The forge rolling contours 12 are provided so as to form a component 2 passed between the forging rolls 10 in a passage direction D. In this case, this forming comprises in particular the bending according to the invention of the component 2 transversely to its original longitudinal extension and can furthermore comprise material distribution, known in the forge rolling method, in the direction of the original longitudinal extension of the component 2 (i.e. in particular a cross-sectional change of the component 2), as is illustrated for example in FIGS. 1*a-b.*

The forge rolling contours 12 are configured so as to bend the component 2, passed between the forging rolls 10, in at least one direction transversely to the passage direction D of the component 2, at least in a subregion 13 of the forge rolling contours 12, preferably at least with regard to its original longitudinal extension. In FIGS. 3 to 6 and their subparts, this transverse direction is in the drawing plane. As a result of the component 2 being rotated around its "original" longitudinal axis or with regard to the passage direction D (i.e. around the axis in the direction of the passage direction D) as the component 2 is passed between the forging rolls 10, three-dimensional bending of the component 2 can also be achieved.

In order to bend the component 2, the first and the second forging roll 10, at least the forge rolling contours 12 of the two forging rolls 10, can be formed mirror symmetrically to one another. The mirror plane in this case extends preferably between the two forging rolls 10 and in the passage direction D.

As can be gathered in particular from FIGS. 3 to 6 and their subparts, at least some of the forge rolling contour 12, as seen around the circumference of the respective forging roll 10, preferably extends transversely to a plane E which is perpendicular to the respective axis of rotation R, in order to bend the component 2, passed between the forging rolls 10, in at least one direction transversely to the passage direction D of the component 2. In the figures illustrated here, as already explained, the bending takes place in the drawing plane.

As can also be gathered from FIGS. 3 to 6 and their subparts, the respective forge rolling contour 12 has, at least in one subregion, a side face 14 which faces in an axial direction and via which the component 2 can be bent. In other words, a side face 14 is provided which presses laterally against the component 2 in the drawing plane in the illustrations, shown here, of FIGS. 3 to 6 and their subparts, and thus bends it in the corresponding region of the component 2.

As can likewise be gathered from FIGS. 3 to 6 and their subparts, the forge rolling contour 12 is particularly preferably in the form of a defined groove, in particular a profile groove, in at least one of the forging rolls 10. The respectively other forging roll can then have for example an identical forge rolling contour, or at least a forge rolling contour which corresponds to the forge rolling contour 12 of the first forging roll 10 and which can also be provided for example by the (for example cylindrical and substantially smooth) surface of the other forging roll. The side face 14 of the aforementioned subregion 13 of the forge rolling contour 12 can preferably be formed by a side face of the groove.

In the region in which the forging rolls 10 are located closest together, the two corresponding and mutually opposite forge rolling contours 12 can preferably to some extent laterally surround a forming region 15 through which the components 2 can be passed in the passage direction D in order to be formed. Thus, the forming region 15 is laterally bounded at least in the direction toward the axes of rotation R and consequently forms the contour for the forge rolling of the components 2. The forming region 15 is also defined by the aforementioned side faces 14, at least in the regions which serve for bending the component 2, such that the bending forge rolling process according to the invention can be carried out by means of the forge rolling device 1 according to the invention.

As can furthermore be gathered from FIGS. 3 to 6 and their subparts, that subregion 13 of the forge rolling contour 12 that serves to bend the component 2 can transition continuously or discontinuously into the adjoining regions of the forge rolling contour. This preferably results in particular in a stepped or arcuate (see FIGS. 3*a-c*, 4*a-b* and 5*a-b*) or undulating (cf. FIGS. 6*a-c*) forge rolling contour 12. Of course, other contour shapes are also conceivable, which lead to the desired complex component geometry.

At least some of the radially extending normals connecting the forge rolling contour 12 and the axis of rotation R intersect the axis of rotation R, as seen around the circumference of the respective forging roll 10, at different points P. This goes at least for that subregion 13 of the forge rolling contour 12 in which the component region to be bent is guided through the forge rolling device 1.

According to a particularly preferred embodiment, the forging rolls 10 are arranged so as to be driven in opposite directions to one another. In this way, active passing of the component 2 through the forging roll device 1 is preferably provided at the same time.

According to a particularly preferred embodiment, the forge rolling device 1 has several forming stages, wherein at least one of the forming stages, preferably at least the last of the forming stages, has the above-described first and second forging rolls 10 for bending the component 2. The other forming stages can in this case be in the form of known forge rolling forming stages and serve only for the mass distribution of the component in the longitudinal direction L or likewise be configured as per the forming stage according to the invention.

Figure 1A:
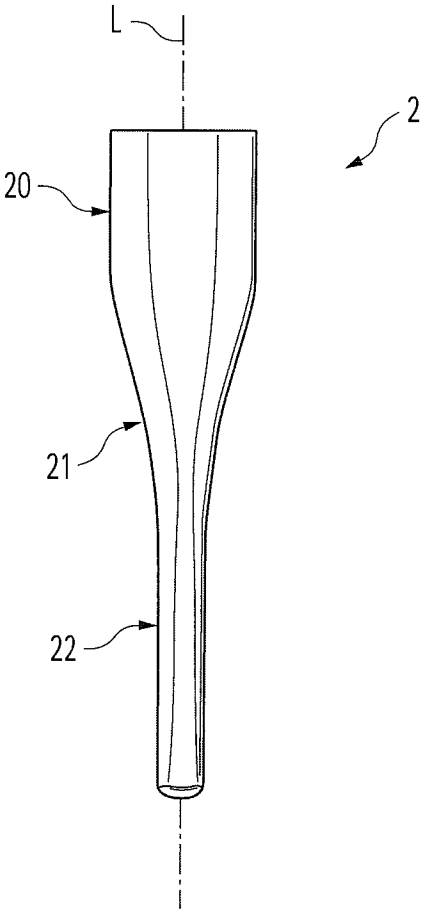
Figure 2C:
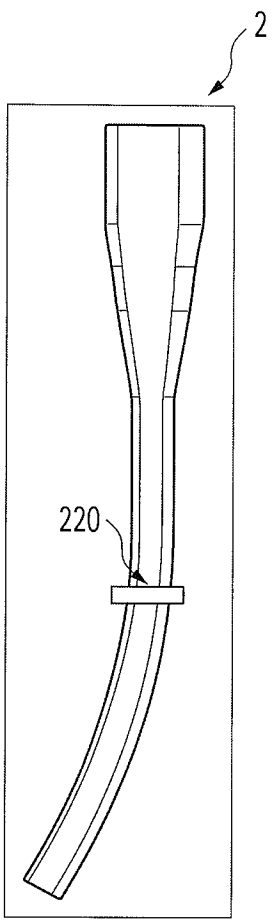
FIGS. 2*a*, 2*b*, and 2*c* show three exemplary embodiments of a component according to the invention after the bending forge rolling process according to the invention has been carried out.
Figure 2B:
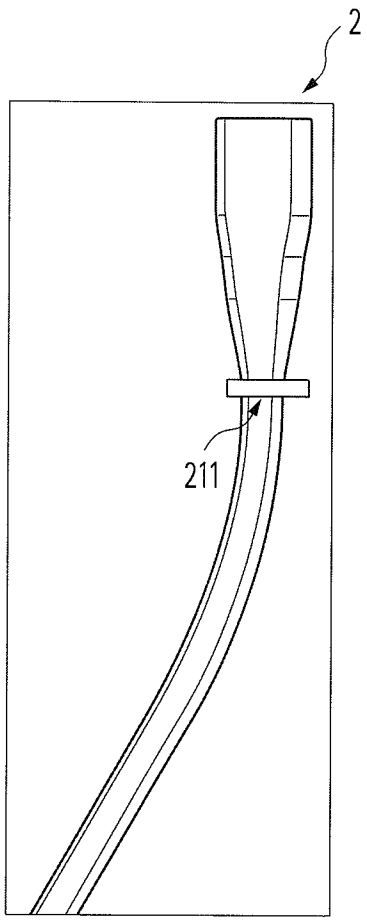
Figure 2A:
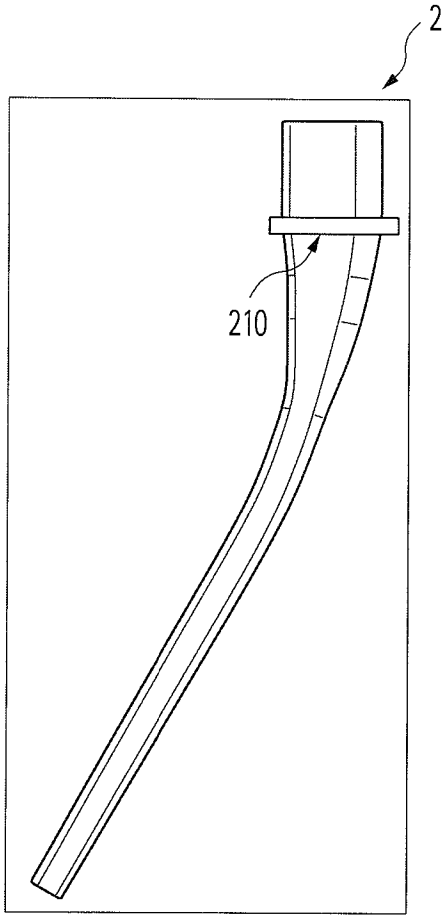

FIGS. 1*a-b* show a component 2 provided for the forge rolling operation according to the invention by means of the forge rolling device 1 according to the invention. This can already have been shaped for example by means of conventional forge rolling methods for defined mass distribution in preceding forge rolling stages. As shown in FIGS. 1*a-b*, the component 2 illustrated here by way of example has a large-diameter region 20, a conical region 21 and a shank region 22. The component is produced in particular from metal, for example aluminum or steel. However, other materials are also conceivable, which can be subjected to a forge rolling process and for example also to a subsequent (drop) forging process. The component 2 illustrated here is a simplified illustration of a component 2 as can be used for example for use in a forge rolling device 1 according to the invention. The invention is not limited to the shape of the component 2 illustrated.

In the following text, a method according to the invention for the bending forge rolling of a component 2, in particular of a component blank, is described.

The method according to the invention comprises, in a first step, the provision of a bending forge rolling device. This can be in particular the bending forge rolling device 1 according to the invention.

In a second step, a component 2 is then provided. This can be for example an elongate component 2, as shown in FIGS. 1*a-b*. Of course, other components 2 are also conceivable, which preferably have an elongate component extension (or longitudinal axis) L.

According to a third step, the component 2 is passed between the two forging rolls 10 of the bending forge rolling device 1 in the region of the opposite forge rolling contours 12 of the forging rolls 10 in order to form the component 2. This is shown for example in FIGS. 3 to 6 and their subparts, wherein the passage direction D is directed upward in the drawing plane; the components 2 have thus already been substantially guided for the most part through the forge rolling device 1. In the last forming step of the method according to the invention, the component 2 is bent, at least in a subregion of the forge rolling contour 12, in at least one direction transversely to the passage direction D (in this case to the right) of the component 2. Furthermore, a cross-sectional change of the component 2 can also take place.

Depending on the region of the forge rolling contour 12 in which the latter extends longitudinally with regard to the axis of rotation R, bending of the component 2 at any desired, defined point or over any desired defined region can be implemented. For example, according to FIG. 3*a*, the subregion for bending is located in a region of the forging roll 10 that is illustrated at the top here, such that the component 2 has been implemented in a region 210 of the start of the cone in this exemplary embodiment. According to FIG. 3*b*, the subregion for bending is located in the topmost quarter of the forging roll 10 illustrated here, such that the component 2 has been implemented in a region 211 of the end of the cone in this exemplary embodiment. According to FIG. 3*c*, the subregion for bending is located in the central third of the forging roll 10 illustrated here above the axis of rotation R, such that the component 2 has been implemented in a region 220 of the shank 22 in this exemplary embodiment.

Figure 3C:
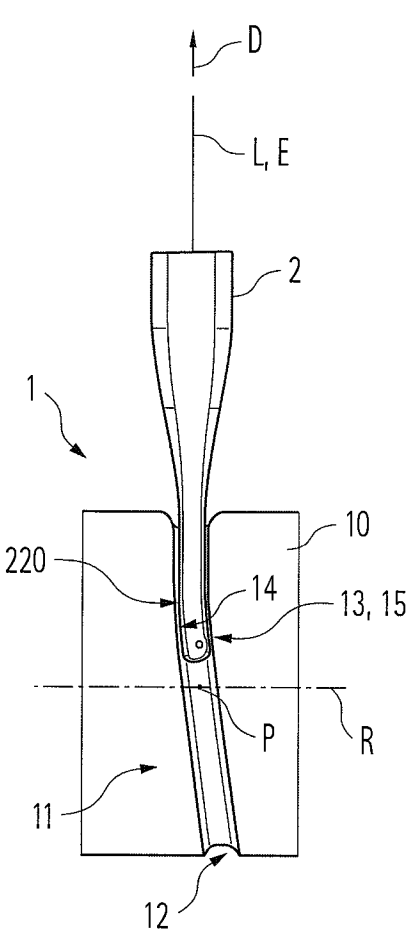
FIGS. 3*a*, 3*b*, and 3*c* show a simplified illustration of three exemplary embodiments of a forge rolling device according to the invention for producing the components according to FIGS. 2*a-c,*
Figure 3B:
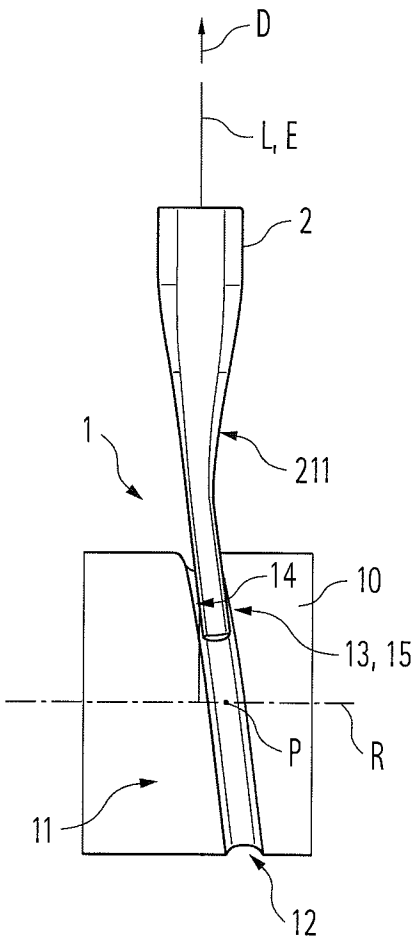
Figure 3A:
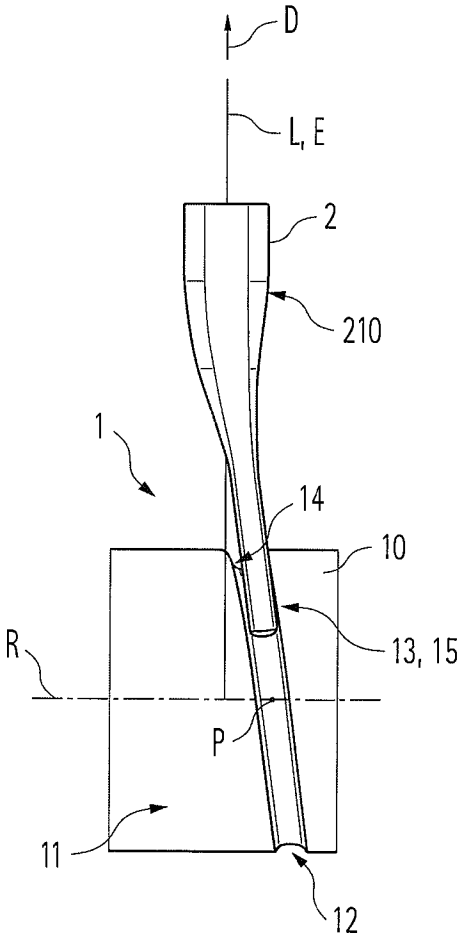
Figure 4B:
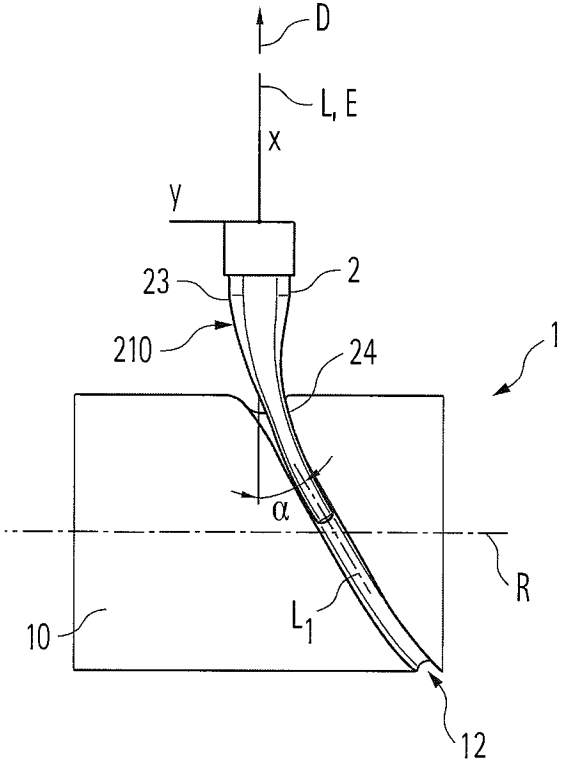
FIGS. 4*a* and 4*b* show two exemplary embodiments of a forge rolling device as per the one in FIG. 3*a* with different bending angles.
Figure 4A:
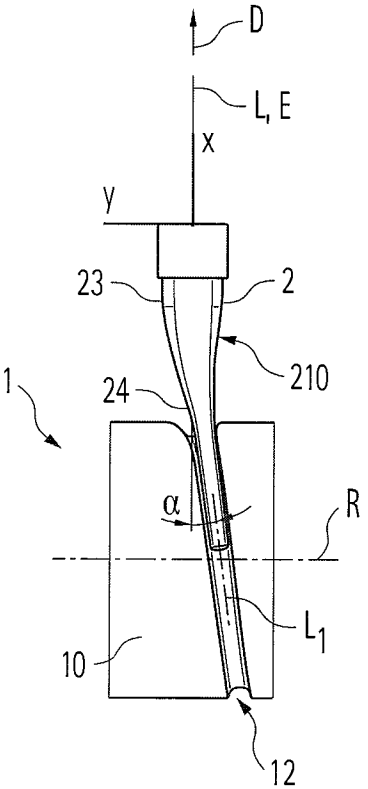
Figure 5B:
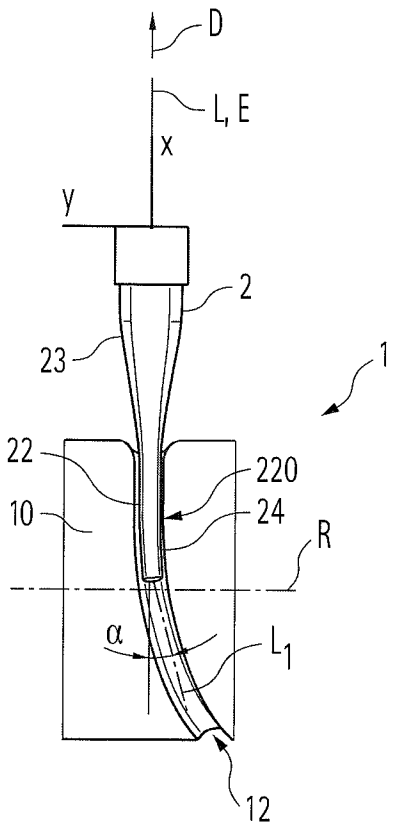
FIGS. 5*a* and 5*b* show two exemplary embodiments of a forge rolling device as per the one in FIG. 3*c* with different bending angles.
Figure 5A:
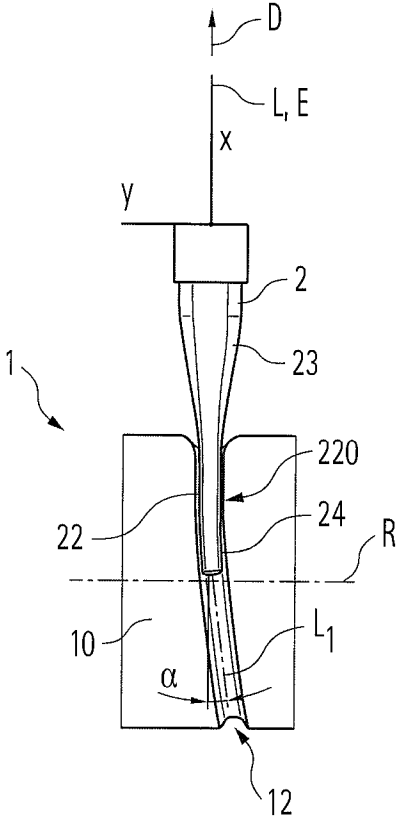

With reference to FIGS. 4*a-b*, two different embodiments of a corresponding forging roll 10, or forge rolling contour 12, are shown, which are provided for the production of a different bending angle $\alpha$ here in the region of the cone start 210; i.e. bent in a comparable manner to FIG. 3*a*. With reference to FIGS. 5*a-b*, two different embodiments of a corresponding forging roll 10, or forge rolling contour 12, are likewise shown, which are provided for the production of a different bending angle $\alpha$ here in the region of the shank 22; i.e. bent in a comparable manner to FIG. 3*c*.

The bending angle $\alpha$ results from the angle between the longitudinal axes or longitudinal extensions L, $L_1$ of mutually adjoining bending regions 23, 24 of the component 2 that are angled with respect to one another. A different bending angle $\alpha$ can in this case be established in particular by the transverse deviation, illustrated in FIGS. 4 and 5 and their subparts, of the forge rolling contour 12. In particular, in the third step of the method according to the invention, the component 2 can be bent in at least one direction transversely to the passage direction D of the component 2, at least in one subregion 13 of the forge rolling contour 12, in which at least some of the latter, as seen around the circumference of the respective forging roll 10, extends transversely to the plane E which is perpendicular to the respective axis of rotation R. The bending angle $\alpha$ can thus be set, for example via the angle of the longitudinal extension of the forge rolling contour 12, as seen around the circumference of the forging roll 10, with regard to the aforementioned plane E, or via the angle between the longitudinal extension—as seen around the circumference of the forging roll 10—of mutually adjoining forge rolling contour regions that are angled with respect to one another.

Figure 6C:
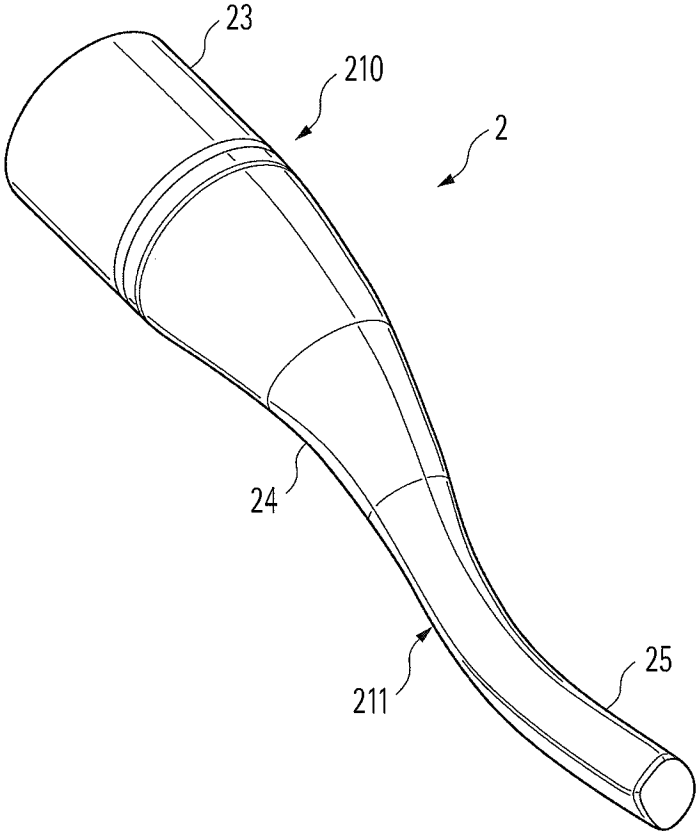
FIGS. 6*a*, 6*b*, and 6*c* show a simplified illustration of a further exemplary embodiment of a forge rolling device according to the invention for providing multiple bending (in this case double bending), and a component produced by means of this forge rolling device.
Figure 6B:
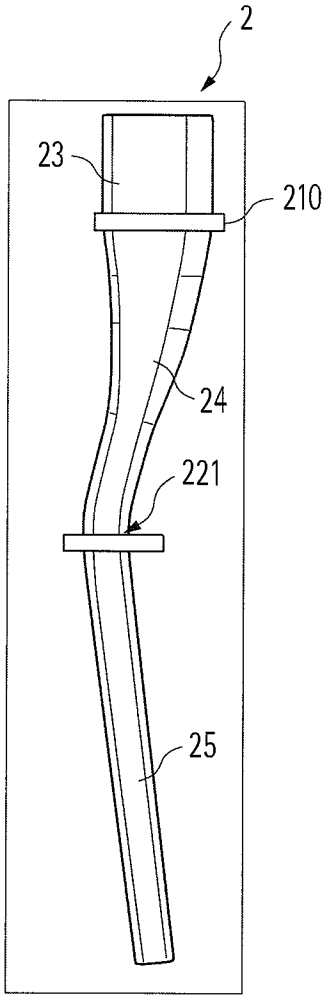
Figure 6A:
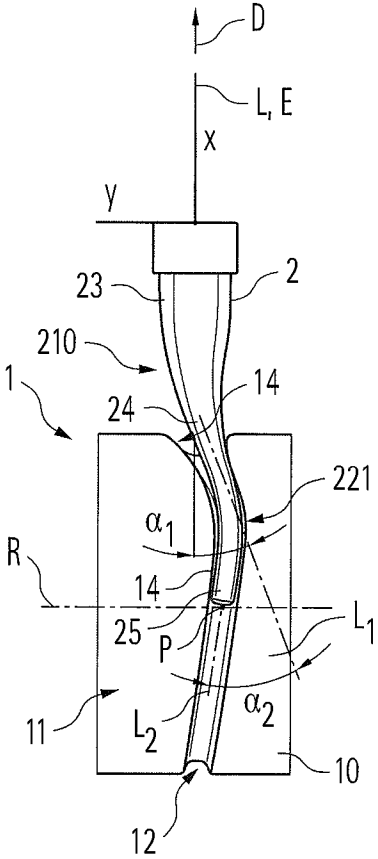

According to a preferred embodiment, the component 2 is bent in particular transversely to its original longitudinal extension L. In this case, the component 2 can also be bent at several regions, in particular as seen with regard to its original longitudinal extension L, as is illustrated for example in FIGS. 6*a-c*. In FIGS. 6*a-c*, the component 2 has been bent in two regions 210 and 221. The (relative) bending angle $\alpha$ (in this case $\alpha_1$, $\alpha_2$) of two adjacent bending regions 23 and 24, or 24 and 25 of the component 2 results in this case preferably in each case from the angle $\alpha_1$, $\alpha_2$ enclosed by the longitudinal axes (or longitudinal extension) L, $L_1$, $L_2$ of the two adjacent bending regions 23 and 24, or 24 and 25.

The forging rolls 10 are driven in opposite directions and run, when viewed in the drawing plane of FIGS. 3 to 6 and their subparts, preferably in a direction of rotation upward; i.e. in the passage direction D of the component 2.

During the third step of the method according to the invention, in a region in which the forging rolls 10 are located closest together, the opposite forge rolling contours 12 to some extent laterally surround a forming region 15 through which the components 2 are passed in order to be formed. The forging rolls 10, at least the forge rolling contours 12, are provided preferably mirror symmetrically to one another. The invention is not limited thereto, however. Other embodiments are also conceivable, wherein the forge rolling contours 12 should each be configured in a manner corresponding to one another in order to be able to create a defined component geometry.

According to a preferred embodiment, the third method step of the method according to the invention can preferably be carried out multiple times. In this case, it is conceivable in particular for the third step to be carried out in this case with forging rolls 10 with different forge rolling contours 12, in order to effect for example continuous bending or component geometry shaping.

Likewise, according to a preferred embodiment, the method according to the invention can also comprise a further step for the longitudinal forge rolling of the component 2 without bending. This step is preferably carried out between the second and third steps of the method according to the invention; but can also be carried out after the third step of the method according to the invention. This additional method step is intended to make it possible to form the component in the direction of its original longitudinal extension L, preferably to distribute the material in a defined manner along its original longitudinal extension L (for example cross-sectional change). The result of this additional forming stage can be for example a component 2 as per FIGS. 1*a-b*.

As already explained above, a component 2 produced by means of the method according to the invention, as illustrated for example in FIGS. 2*a-c*, 6*b* and 6*c*, is also encompassed by the invention. The component 2 according to FIG. 2*a* results for example from a method according to FIG. 3*a*. The component 2 according to FIG. 2*b* results for example from a method according to FIG. 3*b*. The component 2 according to FIG. 2*c* results for example from a method according to FIG. 3*c*.

The present invention is not limited to the above exemplary embodiments, to the extent that it is encompassed by the subject matter of the following claims. Thus, the invention is in particular not limited to a particular forge rolling contour 12 and thus bending and optionally mass distribution of a component 2. Similarly, the invention is not limited to particular dimensions of the forging rolls 10 or of the components 2 to be worked. Also, the material of the components 2 to be worked can be chosen as desired, as long as it can be subjected in principle to a forge.

Another embodiment of the present invention relates to original claims 11 to 19, as summarized below:

Method for the bending forge rolling of a component (2), in particular of a component blank, having the following steps of:

(a) providing a bending forge rolling device, preferably a bending forge rolling device (1) according to one of the preceding claims, (b) providing a component (2), in particular an elongate component (2), and (c) passing the component (2) between two forging rolls (10) of the bending forge rolling device (1) in the region of opposite forge rolling contours (12) of the forging rolls (10) in order to form the component (2), wherein the component (2) is bent in at least one direction transversely to the passage direction (D) of the component (2), at least by means of one subregion (13) of the forge rolling contours (12).

Furthermore, in step (c), the component (2) is preferably bent in at least one direction transversely to the passage direction (D) of the component (2), at least in one subregion (13) of the forge rolling contour (12), in which at least some of the latter, as seen around the circumference of the respective forging roll (10), extends transversely to a plane (E) which is perpendicular to the respective axis of rotation (R).

Preferably, the component (2) is bent transversely to its original longitudinal extension (L).

Preferably, the forging rolls (10) are driven in opposite directions.

Preferably, during step (c), in a region in which the forging rolls (10) are located closest together, the opposite forge rolling contours (12) to some extent laterally surround a forming region through which the component (2) is passed in order to be formed, wherein the forging rolls (10), at least the forge rolling contours (12), are provided preferably mirror symmetrically to one another.

Preferably, step (c) is carried out multiple times, preferably with forging rolls (10) with different forge rolling contours (12).

Preferably, this method further comprises a step for the longitudinal forge rolling of the component (2) without bending, wherein this step is carried out between steps (b) and (c), in order to form the component (2) in the direction of its original longitudinal extension (L), preferably to distribute the material in a defined manner along its original longitudinal extension (L).

Component (2) is preferably produced by a method according to this preferred embodiment.

This said Component (2) preferably has a bending angle $\alpha$ of up to 30°, preferably 40°, particularly preferably 50°.

The invention claimed is:

1. Forge rolling device (1) for the bending forge rolling of a component (2), having:

a first forging roll (10) with a first axis of rotation (R), a second forging roll with a second axis of rotation, wherein each of the forging rolls (10) has, on its surface (11), a forge rolling contour (12) that runs at least partially around its axis of rotation (R), said forge rolling contours (12) corresponding to one another, in order to form a component (2) passed between the forging rolls (10) in a passage direction (D), wherein the forge rolling contours (12) are configured so as to bend the component (2), passed between the forging rolls (10), in at least one direction transversely to the passage direction (D) of the component (2), at least by means of one subregion (13) of the forge rolling contours (12), and wherein the forge rolling contour (12) is in the form of a defined groove in at least one of the forging rolls (10).

2. Forge rolling device (1) according to claim 1, wherein the first and the second forging roll (10), at least the forge rolling contours (12) of the first and second forging rolls (10), are formed mirror symmetrically to one another.

3. Forge rolling device (1) according to claim 1, wherein at least some of the forge rolling contour (12), as seen around the circumference of the respective forging roll (10), extends transversely to a plane (E) which is perpendicular to the respective axis of rotation (R), in order to bend the component (2), passed between the forging rolls (10), in at least one direction transversely to the passage direction (D) of the component (2).

4. Forge rolling device (1) according to claim 1, wherein the respective forge rolling contour (12) has, at least in one subregion, and via which the component (2) can be bent.

5. Forge rolling device (1) according to claim 4, wherein the respective forge rolling contour (12) has, at least in the subregion (13) in which it extends transversely to the plane (E) which is perpendicular to the respective axis of rotation (R), a side face (14) which faces in an axial direction and via which the component (2) can be bent.

6. Forge rolling device (1) according to claim 5, wherein the side face (14) further faces toward the side of the transverse extent.

7. Forge rolling device (1) according to claim 1, wherein that subregion (13) of the forge rolling contour (12) that serves to bend the component (2) transitions continuously or discontinuously into the adjoining regions of the forge rolling contour (12).

8. Forge rolling device (1) according to claim 1, wherein that subregion (13) of the forge rolling contour (12) that serves to bend the component (2) transitions continuously or discontinuously into the adjoining regions of the forge rolling contour (12) in a stepped, arcuate or undulating manner.

9. Forge rolling device (1) according to claim 1, wherein at least some of a plurality of radially extending normals connecting the forge rolling contour (12) and the axis of rotation (R) intersect the axis of rotation (R), as seen around the circumference of the respective forging roll (10), at different points (P), at least in the subregion (13) of the forge rolling contour (12).

10. Forge rolling device (1) according to claim 1, wherein, in the region in which the forging rolls (10) are located closest together, the mutually opposite forge rolling contours (12) to some extent laterally surround a forming region through which the component (2) can be passed in the passage direction (D) in order to be formed.

11. Forge rolling device (1) according to claim 1, wherein the forging rolls (10) are arranged so as to be driven in opposite directions to one another.

12. Forge rolling device (1) according to claim 1, wherein the forge rolling device (1) has several forming stages, wherein at least one of the forming stages has the first and second forging rolls (10) for bending the component (2).

13. Forge rolling device (1) according to claim 12, wherein at least the last of the forming stages has the first and second forging rolls (10) for bending the component (2).

14. Forge rolling device (1) according to claim 1, wherein the component (2) is a component blank.

15. Forge rolling device (1) according to claim 1, wherein the defined groove is a profile groove.

16. Forge rolling device (1) according to claim 1, wherein a side face (14) of the subregion (13) of the forge rolling contour (12) which faces in an axial direction and via which the component (2) can be bent is formed by a side face of the groove.

* * * * *